US006954948B1

(12) United States Patent
Asack et al.

(10) Patent No.: US 6,954,948 B1
(45) Date of Patent: Oct. 18, 2005

(54) SWIMMING POOL COVER HAVING BUILT-IN DRAIN PUMP

(76) Inventors: Robert M. Asack, 35 Satucket Ave., East Bridgewater, MA (US) 02333-1950; Denise A. Asack, 35 Satucket Ave., East Bridgewater, MA (US) 02333-1950

( * ) Notice: Subject to any disclaimer, the term of this patent is extended or adjusted under 35 U.S.C. 154(b) by 0 days.

(21) Appl. No.: 10/847,032

(22) Filed: May 17, 2004

(51) Int. Cl.[7] ..... E04H 4/00
(52) U.S. Cl. ..... 4/498
(58) Field of Search ..... 4/496, 498; 220/219

(56) References Cited

U.S. PATENT DOCUMENTS 4,148,361 A * 4/1979 Christensen ..... 169/66
4,834,138 A 5/1989 Dellasso
4,853,984 A 8/1989 Celiano
D328,748 S 8/1992 Eng
6,487,733 B2 12/2002 Bonelli et al.
6,658,674 B2 12/2003 Bonelli et al.
6,817,042 B1 * 11/2004 Stanneck ..... 4/498

* cited by examiner

*Primary Examiner*—Charles E. Phillips
(74) *Attorney, Agent, or Firm*—Donald R. Schoonover

(57) ABSTRACT

An accessory for a swimming pool includes pool cover means having a top surface, a bottom surface and a peripheral edge wherein the pool cover means is dimensioned to completely span and extend beyond all edges of the swimming pool; motorized water pump means having a pump input with a first hose connection and a pump output with a second hose connection adapted to threadably connect to a garden-type hose; a flexible hose portion having a hose inlet and a hose outlet wherein the hose outlet is connected to the first hose connection of the pump input; and drain cover means secured to the top surface of the pool cover means wherein the drain cover means establishes a location of the pump means on the top surface of the pool cover means such that the second hose connection of the pump output is operatively spaced in close proximity to an edge of the swimming pool, protects the pump means from the elements, and operatively locates the hose portion such that the hose inlet is spaced near the center of the swimming pool when the pool cover means is in use.

11 Claims, 1 Drawing Sheet

SWIMMING POOL COVER HAVING BUILT-IN DRAIN PUMP

BACKGROUND OF THE INVENTION

1. Field of the Invention

The present invention is related to accessories for swimming pools and, more specifically without limitation, to protective covers for swimming pools.

2. Discussion of the Related Art

A swimming pool is a common source of entertainment, recreation, and exercise AT many residential homes. Such swimming pools can be either in-ground or above-ground. A common concern with swimming pools occurs during cooler seasons, such as early Spring, Autumn and Winter, when most pools lie dormant from non-use. During such dormant periods, the level of water in the pool is generally lowered and a canvas tarpaulin or plastic cover is placed on the pool in an attempt to keep debris, such as fallen leaves, from entering the pool and contaminating the water remaining in the pool.

All too often, rain and snow accumulate on the cover during those dormant periods. Worse yet, debris falls or is blown into that accumulated water where the debris, particularly leaves, become water-logged. When warm weather returns and it is time to reopen the pool, not only must the cover be removed but the heavy, unwieldly, water-logged debris must also be dealt with. Unfortunately, some of that unwanted debris and the associated contaminated water on top of the pool cover invariably gets spilled into the pool water while removing the cover.

What is needed is a pool cover with a built-in water pump that eliminates or at least minimizes the extent of water-logging of debris on the top of a pool cover during the off-season, and that eliminates or at least minimizes the extent to which unwanted debris and the associated contaminated water on top of the pool cover gets spilled into the pool water when the pool cover is being removed.

PRINCIPAL OBJECTS AND ADVANTAGES OF THE INVENTION

The principal objects and advantages of the present invention include: providing a pool cover with a built-in pump for removing accumulated water from the top of the pool cover; providing such a pool cover wherein the pump is connectable to a garden-type hose for removing the water from the top of the pool cover; providing such a pool cover that includes a flexible hose portion having a hose inlet operatively spaced near the center of a swimming pool when the pool cover is in use; providing such a pool cover having a drain cover that establishes and maintains the location of, and protects, the built-in pump on the top of the pool cover; providing such a pool cover wherein a power cord of the built-in pump includes an on/off switch for activating and deactivating the built-in pump; providing such a pool cover that includes a ballast operatively located on the top surface of the pool cover such that water on the surface of the pool cover drains to a depression formed by the ballast in the top surface of the pool cover; providing such a pool cover that includes a water level sensor wherein the built-in pump is automatically activated when the depth of accumulated water in the depression formed by the ballast surpasses a predetermined level; providing such a pool cover that includes a strainer that prevents debris on the top of the pool cover from entering the built-in pump; and generally providing such a pool cover that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

The improvements of the accessory for a swimming pool of the present invention include swimming pool cover means having a top surface, a bottom surface and a peripheral edge wherein the pool cover means is dimensioned to completely span and extend beyond all edges of the swimming pool; motorized water pump means having a pump input with a first hose connection and a pump output with a second hose connection adapted to threadably connect to a garden-type hose; a flexible hose portion having a hose inlet and a hose outlet wherein the hose outlet is connected to the first hose connection of the pump input; and drain cover means secured to the top surface of the pool cover means wherein the drain cover means establishes a location of the pump means on the top surface of the swimming pool cover such that the second hose connection of the pump output is operatively spaced in close proximity to an edge of the swimming pool, protects the pump means from the elements, operatively locates the hose portion such that the hose inlet is spaced near the center of the swimming pool when the cover means is in use, and locates an electrical connector of the pump means near an edge of the swimming pool to thereby provide easy access thereto.

The accessory may include a ballast operatively located on the top surface of the pool cover means, wherein the ballast is spaced near the hose inlet of the hose portion to thereby cause accumulated water on the top surface of the pool cover means to drain to a depression operatively formed in the pool cover means by the ballast. In that event, the pump means includes a control mechanism. A water level sensor positioned in the depression formed by the ballast is adapted to determine whether accumulated water in the depression has reached a predetermined level. An electrical connection connects the water level sensor to the control mechanism such that the pump means is automatically activated when electrical power is supplied to the pump means and the water level sensor has determined that accumulated water in the depression has reached the predetermined level.

Preferably, the accessory includes a strainer mechanism connected to the hose inlet to prevent debris on the top surface of the pool cover means from entering the hose portion.

For above-ground pools, the accessory may include a channel formed along the peripheral edge of the pool cover means; and an elongate, flexible securing element positioned in the channel to secure the peripheral edge of the pool cover means about sides of an above-ground swimming pool.

DETAILED DESCRIPTION OF THE INVENTION

Figure 1:
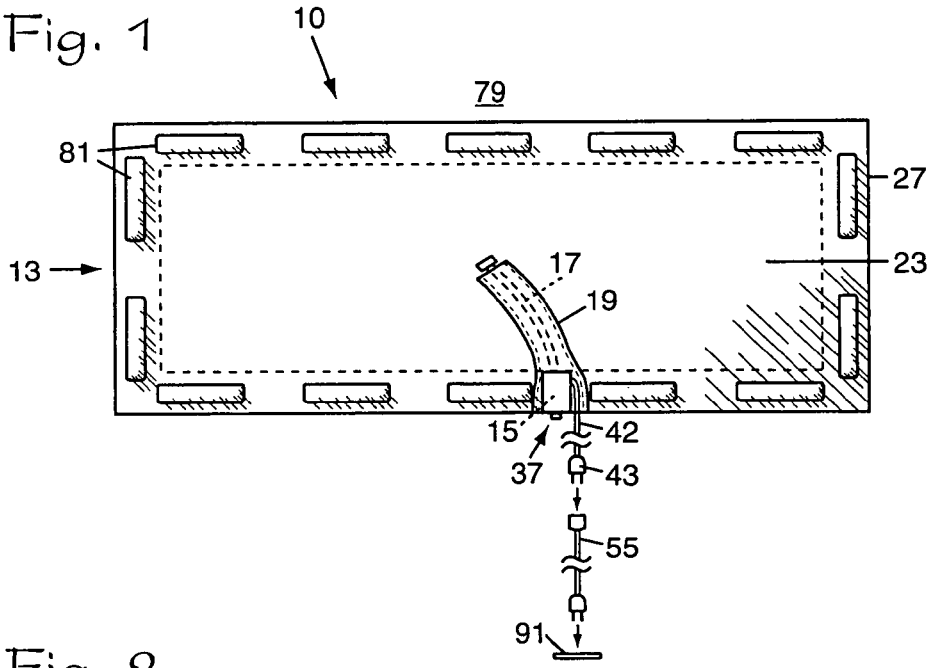
FIG. 1 is a top plan view of a swimming pool cover having a built-in drain pump, according to the present invention.
Figure 2:
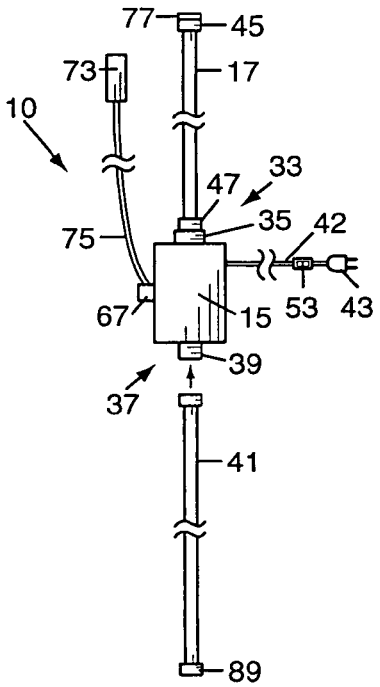
FIG. 2 is an enlarged and fragmentary top plan view of various components of the swimming pool cover having a built-in drain pump, according to the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The reference numeral 10 generally refers to an accessory for a swimming pool in accordance with the present invention, as shown in FIGS. 1 through 4. The accessory 10 includes swimming pool cover means 13, water pump means 15, a hose portion 17, and drain cover means 19.

The swimming pool cover means 13 is constructed of canvas, plastic or other suitable material and has a top surface 23, a bottom surface 25, and a peripheral edge 27. The swimming pool cover means 13 is dimensioned to completely span and extend beyond all edges of the swimming pool.

The water pump means 15, such as a 120-volt electrically motorized pump, has a pump input 33 with a first hose connection 35 and a pump output 37 with a second hose connection 39. The second hose connection 39 is adapted to be threadably connected to a garden-type hose 41. The pump means 15 includes an electrical power cord 42 with an electrical connector 43.

The hose portion 17 is constructed of flexible material and has a hose inlet 45 and a hose outlet 47. The hose outlet 47 is connected to the first hose connection 35 of the pump input 33.

The drain cover means 19 is constructed of canvas, plastic or other suitable material. The drain cover means 19 is secured to the top surface 23 of the pool cover means 13, such as by stitching, adhesive, or other suitable means. The drain cover means 19 is dimensioned and secured to the pool cover means 13 such that a location for the pump means 15 on the top surface 23 of the pool cover means 13 is established wherein the second hose connection 39 of the pump output 37 is operatively spaced in close proximity to an edge of the swimming pool, the pump means 15 is protected from the elements, and the hose inlet 45 of the hose portion 17 is spaced near the center of the swimming pool when the pool cover means 13 is in use. In addition, the drain cover means 19 is dimensioned and secured to the pool cover means 13 such that the electrical connector 43 is located near the edge of the swimming pool to thereby provide easy access to the electrical connector 43 when the pool cover means 13 is in use.

If desired, an on/off switch 53 may be mounted in the electrical power cord 42 near the electrical connector 43 so that, instead of connecting and disconnecting an extension cord 55 to and from the electrical connector 43 in order to control operation of the pump means 15, the on/off switch 53 can be used to activate and deactivate the pump means 15 when electrical power is being supplied to the electrical power cord 42.

The accessory 10 of the present invention may include an optional ballast 63, which is generally placed on the top surface 23 of the pool cover means 13 near the hose inlet 45 of the hose portion 17. The weight of the ballast 63 causes a depression 65 to be formed in the top surface 23 of the pool cover means 13. As a result, accumulated water on the top surface 23 of the pool cover means 13 will tend to drain to the depression 65. Preferably, the ballast 63 is circularly-shaped with rounded edges to minimize wear and tear on the pool cover means 13 by the ballast 63.

For applications using the ballast 63, the pump means 15 may include a control means 67, such as a switching mechanism, for activating and deactivating the pump means 15. In that event, the accessory 10 may also include a water level sensor 73 positioned in the depression 65 formed in the pool cover means 13 by the ballast 63 as aforesaid. An electrical connection 75 connects the water level sensor 73 to the control means 67. When the water level sensor 73 determines that the depth of accumulatd water in the depression 65 has reached a predetermined level and accordingly signals the control means 67 via the electrical connection 75, the pump means 15 is automatically activated if electrical power is being supplied to the pump means 15. As a result, water that has accumulated in the depression 65 is automatically drained from the top surface 23 of the pool cover means 13. When the pump means 15 has drained a sufficient quantity of accumulated water from the depression 65 such that the accumulated water in the depression 65 no longer reaches the predetermined level, the signal being communicated to the control means 67 by the water level sensor 73 is terminated and the control means 67 automatically deactivates the pump means 15.

Preferably, the accessory 10 of the present invention includes a strainer mechanism 77 connected to the hose inlet 45, wherein the strainer mechanism 77 prevents debris on the top surface 23 of the pool cover means 13 from entering the hose portion 17.

In applications for in-ground pools, the portion of the pool cover means 13 that extends beyond the pool and onto a surrounding deck may be anchored by weighting with sand bags 81, or other suitable means to thereby withstand the breezes to which pool covers are normally subjected. In applications for above-ground pools, the pool cover means 13 may be anchored by means of a channel 83 formed along the peripheral edge 27 of the pool cover means 13. An elongate, flexible securing element 85 positioned in the channel 83, such as a cord or cable or other suitable means, may be used to secure the peripheral edge 27 of the pool cover means 13 against the sides of the pool.

It is to be understood that the accessory 10 of the present invention can be adapted to almost any size or shape of pool, including without limitation rectangularly-shaped, oval-shaped, and circularly-shaped swimming pools.

In an application of the present invention, the pool cover means 13, with the top surface 23 facing upwardly, is spread across a pool wherein the water has been lowered; and is anchored as hereinbefore described. The hose inlet 45 should be spaced near the center of the pool and each of the pump output 37 and the electrical connector 43 should be spaced near an appropriate edge of the pool as dictated by the drain cover means 19. Subsequently, when it is observed that water has accumulated on the top surface 23 of the pool cover means 13, one end of the garden-type hose 41 is threadably connected to the second hose connection 39 of the pump output 37 and the other end 89 of the garden-type hose 41 is placed where it is desired to discharge the accumulated water to be drained from the top surface 23 of the pool cover means 13. Then, one end of the extension cord 55 is connected to an external receptacle 91 of a nearby house. When the other end of the extension cord 55 is connected to the electrical connector 43 of the power cord 42 of the pump means 15, the pump means 15 is immediately activated whereupon the accumulated water on the top surface 23 of the pool cover means 13 is extracted through the hose inlet 45 of the hose portion 17, through the hose portion 17, through the pump means 15, and through the garden-type hose 41 from which it is discharged. The strainer mechanism 77 prevents debris on the top surface 23 of the pool cover means 13 from being drawn into the hose portion 17 with the accumulated water being drained. When the accumulated water on the top surface 23 of the pool cover means 13 is drained down to where the hose portion 17 begins sucking air, the extension cord 55 is disconnected from the electrical connector 43, thereby deactivating the pump means 15 until the next time it is desired to drain more accumulated water from the top surface 23 of the pool cover means 13.

Figure 3:
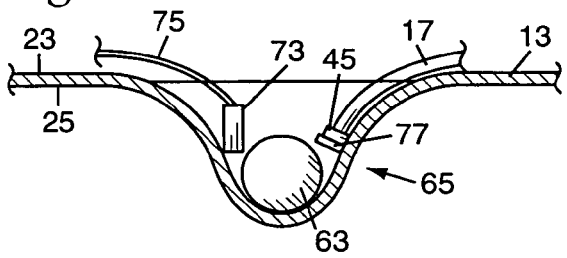
FIG. 3 is an enlarged and fragmentary, cross-sectional view showing an optional ballast and a depression formed by the ballast of the swimming pool cover having a built-in drain pump, according to the present invention.
Figure 4:
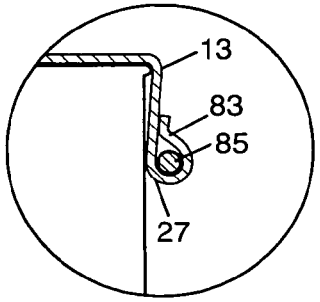
FIG. 4 is a fragmentary cross-sectional view of a channel and securing of an above-ground pool variation of the swimming pool cover having a built-in drain pump, according to the present invention.

If an application is to use the automatic mode of operation, the ballast 63 is placed near the hose inlet 45 to form the depression 65 in the top surface 23 of the pool cover means 13 such that the hose inlet 45 dips downwardly into the depression 65, as indicated in FIG. 3. The water level sensor 73 is positioned in the depression 65 and connected to the control means 67 with the electrical connection 75. The extension cord 55 connects the electrical connector 43 to the external receptacle 91 as aforesaid. When the accumulated water level in the depression 65 reaches a predetermined level, the pump means 15 is automatically activated and when the accumulated water is drained down to where it no longer reaches the predetermined level, the pump means 15 is automatically deactivated. The automatic mode of operation should be avoided, however, when the ambient temperature is below freezing.

It is to be understood that while certain forms of the present invention have been illustrated and described herein, it is not to be limited to the specific forms or arrangement of parts described and shown.

What is needed and desired to be covered by Letters Patent is as follows:

1. An accessory for a swimming pool, comprising:

(a) pool cover means having a top surface, a bottom surface and a peripheral edge; the pool cover means dimensioned to completely span and extend beyond all edges of the swimming pool;

(b) motorized water pump means having a pump input with a first hose connection and a pump output with a second hose connection, adapted to threadably connect to a garden-type hose;

(c) a flexible hose portion having a hose inlet and a hose outlet, wherein the hose outlet is connected to the first hose connection of the pump input; and (d) drain cover means secured to the top surface of the pool cover means, wherein the drain cover means:

(1) establishes a location of the pump means on the top surface of the pool cover means such that the second hose connection of the pump output is operatively spaced in close proximity to an edge of the swimming pool, (2) protects the pump means from the elements, and (3) operatively locates the hose portion such that the hose inlet is spaced near the center of the swimming pool when the pool cover means is in use.

2. The accessory as described in claim 1, wherein the pump means is electrically powered.

3. The accessory as described in claim 2, wherein:

(a) the pump means includes an electrical power cord with an electrical connector; and (b) the drain cover means locates the electrical connector near the edge of the swimming pool to thereby provide easy access to the electrical connector.

4. The accessory as described in claim 3, further comprising an on/off switch mounted in the electrical power cord near the electrical connector, wherein the on/off switch may be used to activate and deactivate the pump means when electrical power is supplied to the electrical power cord.

5. The accessory as described in claim 2, further comprising a ballast operatively located on the top surface of the pool cover means, wherein the ballast is spaced near the hose inlet of the hose portion to thereby cause accumulated water on the top surface of the pool cover means to drain to a depression operatively formed in the pool cover means by the ballast.

6. The accessory as described in claim 5, further comprising:

(a) the pump means including a control means;

(b) a water level sensor positioned in the depression formed by the ballast to determine whether accumulated water in the depression has reached a predetermined level; and (c) an electrical connection connecting the water level sensor to the control means; and (d) wherein the pump means is automatically activated when electrical power is supplied to the pump means and the water level sensor has determined that accumulated water in the depression has reached the predetermined level.

7. The accessory as described in claim 1, further comprising a strainer mechanism connected to the hose inlet, wherein the strainer mechanism prevents debris on the top surface of the pool cover means from entering the hose portion.

8. The accessory as described in claim 1, further comprising:

(a) a channel formed along the peripheral edge of the pool cover means; and (b) an elongate, flexible securing element positioned in the channel, wherein the securing element may be used to secure the peripheral edge of the pool cover means about sides of an above-ground swimming pool.

9. The accessory as described in claim 1, wherein the pool cover means is rectangularly-shaped for use with a rectangularly-shaped swimming pool.

10. The accessory as described in claim 1, wherein the pool cover means is oval-shaped for use with an oval-shaped swimming pool.

11. The accessory as described in claim 1, wherein the pool cover means is round for use with a circularly-shaped swimming pool.

* * * * *